United States Patent [19]

Briar et al.

[11] 4,154,412

[45] May 15, 1979

[54] EXPANDABLE COLLET

[75] Inventors: Thomas J. Briar, Trafford; Walter J. Reese, North Huntington, both of Pa.

[73] Assignee: PPG Industries, Inc., Pittsburgh, Pa.

[21] Appl. No.: 869,744

[22] Filed: Jan. 16, 1978

Related U.S. Application Data

[63] Continuation of Ser. No. 701,394, Jun. 30, 1976, abandoned.

[51] Int. Cl.[2] ..... B65H 75/30

[52] U.S. Cl. ..... 242/46.4; 242/72 R

[58] Field of Search ..... 242/72, 72.1, 72 B, 242/46.4, 68.2, 18 G

[56] References Cited

U.S. PATENT DOCUMENTS

| | | | |
|---|---|---|---|
| 2,433,304 | 12/1947 | Stream | 242/18 G |
| 2,705,111 | 3/1955 | Bruestle | 242/72.1 |
| 2,890,001 | 6/1959 | Triquet | 242/72.1 |
| 3,127,124 | 3/1964 | Tidland et al. | 242/72 B |
| 3,371,877 | 3/1968 | Klink et al. | 242/18 G |
| 3,394,902 | 7/1968 | Hise et al. | 242/72 B |
| 3,448,937 | 6/1969 | Beck | 242/72 R |
| 3,813,051 | 5/1974 | Miller | 242/46.4 |

FOREIGN PATENT DOCUMENTS

| | | | |
|---|---|---|---|
| 610079 | 10/1948 | United Kingdom | 242/72 |
| 1102659 | 2/1968 | United Kingdom | 242/72 |

*Primary Examiner*—George F. Mautz

*Attorney, Agent, or Firm*—Paul A. Leipold; Alan T. McDonald

[57] ABSTRACT

A collet for winding strand material, such as glass strands, is disclosed. The collet is capable of expanding under fluid pressure to firmly grasp a tube on which the strand material is wound. The collet comprises a sealed chamber into which the fluid enters under pressure, a piston which is movable by the fluid pressure, expandable rings and inexpandable spacers between the rings and at the end of the set of rings opposite the piston; the piston, rings, and spacers being located along a common shaft and arranged such that fluid entering the chamber forces the piston towards the rings and spacers creating pressure on the expandable rings and expanding them to firmly grasp the covering tube.

4 Claims, 2 Drawing Figures

EXPANDABLE COLLET

This is a continuation of application Ser. No. 701,394, filed June 30, 1976, now abandoned.

BACKGROUND OF THE INVENTION

Strand material is typically collected by winding the strands around a tube carried by a rotating collet. In the case of glass strands, glass filaments are attenuated through bushing tips or orifices at the bottom of heated bushing containing molten glass. The filaments as they are attenuated are coated with a binder and/or size by passing the filaments across the surface of an applicator which is constantly wetted with the binder and/or size to be applied. The filaments are then gathered into a unified strand by a gathering shoe, which is typically a grooved wheel or cylinder. The resulting strand may then be transversed in a vehicle riding in a cam or across the face of a rotating spiral and collected as a forming package on a forming tube carried by a rotating collet.

It is necessary to firmly hold the forming tube onto the face of the collect to avoid slippage of the tube as the collet is rotating. This is necessary, since the rotation of the tube with the forming package thereon provides the attenuative forces for the formation of the filaments. Filament diameter is directly proportional to the tension on the filaments from the rotating collet. Should the forming tube slip, uneven tension will be transmitted to the filaments and thus uneven strand diameter results. This results in unacceptable product.

Several solutions to this problem have been employed by the prior art. A first solution is to form the face of the collet of a plurality of fingers which ride within slots or grooves and which are designed to expand outwardly from the collet due to centrifugal force when the collet is rotated. Thus, the face of a collet itself expands to firmly grasp the forming tube. An example of such a collet can be found in U.S. Pat. No. 3,871,592. While this solution is satisfactory for collets having a large diameter as, for example, 12 inches (30.5 centimeters) or more and rotated at high speeds, such a solution is unsatisfactory for collets of smaller diameter, i.e., in the order of 5 inches (12.7 centimeters) and rotated at slower speeds, as is often the case with larger diameter filaments, since the centrifugal forces necessary to expand the fingers is often insufficient.

A second possible solution which is commonly employed is to form the collet, or portion thereof, of an expandable material and "blow-up" the collet by air pressure. This solution takes two forms. In one form, a bladder or hollow tube of expandable material forms at least a portion of the outer part of the collet and is expanded to firmly grasp the tube placed thereon. Typical of this form are U.S. Pat. Nos. 2,289,453; 2,621,867; 3,139,242; 3,394,902; and 3,834,257.

The other form which this solution may take is to form the collet having an interior tube or bladder which is expanded by air pressure to cause a plurality of protrusions located at the surface of the collet to be forced beyond and protrude from the surface of the collet by the bladder or tube when it is expanded. Typical of this solution are U.S. Pat. Nos. 2,215,069; 3,104,074; and 3,127,124.

A problem common to both forms of the air pressure solutions is that these collets tend to be unevenly balanced when expanded. This results in an eccentric rotation of the collet and the forming package and tube being carried thereon and thus the forming package will produce an uneven tension on the strand and an uneven diameter strand. This effect becomes even more pronounced as the collet speed is increased and thus the collet readily becomes unacceptable for the collection of glass strands.

In U.S. Pat. No. 2,801,858 an expandable collet is disclosed which has a single expandable element which is expanded by compressing it at its ends to expand its diameter as its width is decreased. This is accomplished by manually forcing compaction elements towards each other to compress the expandable element therebetween. This type of collet is evenly balanced when expanded. This solution is useful, however, it requires an operator to manually force the compaction elements together which has been found to be a time-consuming and thus inefficient operation. This method is also employed in U.S. Pat. No. 3,165,279 where the expandable element is extended by forcing a compaction element into it to expand its surfaces outwardly. This, too, requires a manual operation to accomplish the result.

It is desirable, therefore, to produce an expandable collet having the advantages of being evenly balanced to produce a uniform rotation and having the quickness of expansion found in the "blown-up" collets to conserve time in doffing and replacing the forming tube and thus reduce cost and increase efficiency.

THE PRESENT INVENTION

The present invention combines the ease of operation of the air operated expandable collets with the precise rotation found in the manually expanded collets. The collet of the present invention involves a sealed chamber into which a fluid may enter under pressure, a piston which reacts to the fluid pressure, a plurality of expandable rings, and a plurality of spacers between the rings and at the end of the rings opposite the piston. The piston, rings, and spacers are all carried along a common shaft around which they are rotated and are so arranged that, upon introducing a fluid under pressure into the sealed chamber, the piston and spacers transfer this pressure to the expandable rings. This pressure on the rings causes the rings to expand and firmly grasp a tube, such as a forming package tube. Upon release of the fluid pressure, the pressure is relieved from the expandable rings, causing the rings to return to their original size and shape and release the tube.

BRIEF DESCRIPTION OF THE DRAWINGS

The expandable collet of the present invention can best be described with reference to the accompanying drawings in which.

DETAILED DESCRIPTIONS OF THE DRAWINGS

Figure 1:
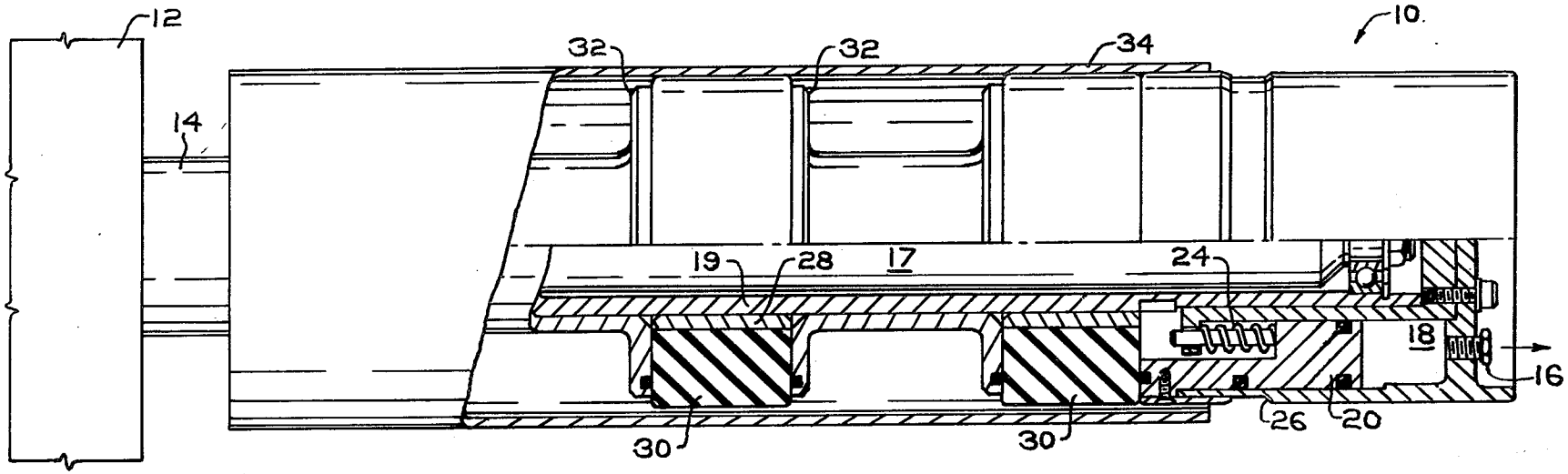
FIG. 1 is a side elevational view, partly in section, of the collet of the present invention in its unexpanded state.
Figure 2:
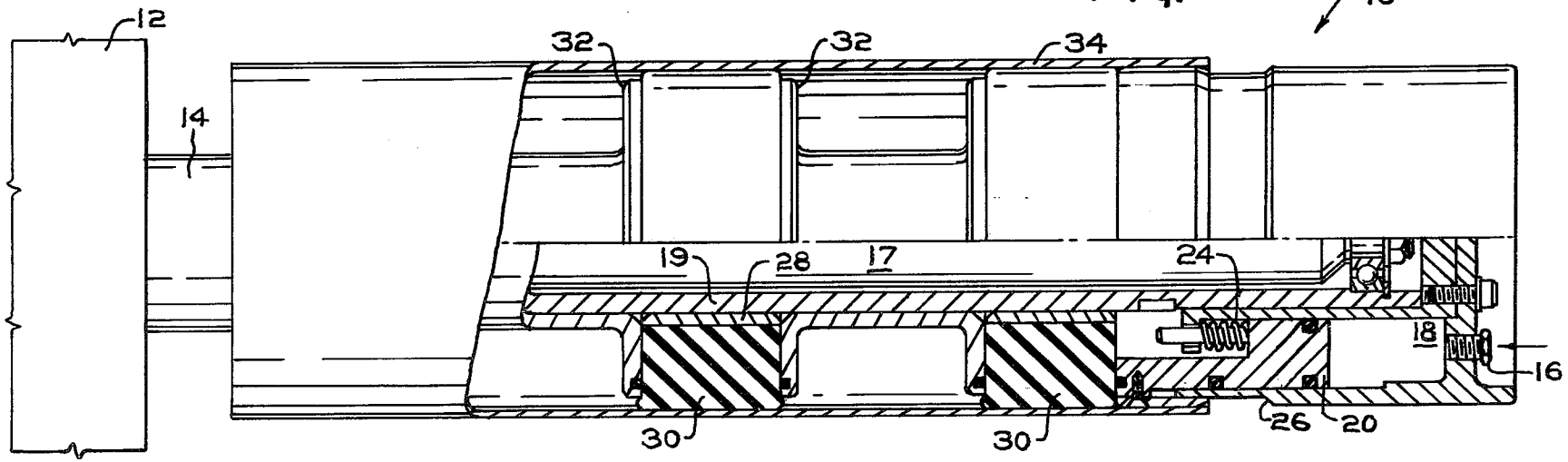
FIG. 2 is a side elevational view partially in section of the collet of the present invention in its expanded state.

Turing now to the Figures, the expandable collet of the present invention is generally illustrated as 10. The collet 10 is connected to a winder 12 through shaft 14 around which the collet 10 rotates. The shaft 14 is connected to a motor, not shown, within the winder 12, the motor supplying the rotational forces for the collet 10. The collet 10 includes a fluid inlet 16 such as a sealed valve which is detachably connected at one end to a source of fluid under pressure, now shown, and at its other end to a fluid chamber 18. The fluid chamber 18 is internally sealed. As the fluid under pressure enters the sealed chamber 18 and the internal pressure within the chamber 18 increases, piston 20, due to the fluid pressure within the chamber 18, presses against expandable ring 30. Piston 20 is connected to a spring 24 which returns piston 20 to its original position upon release of fluid pressure. Stop 26 limits the unexpanded position of the piston 20. Adjacent piston 20 are a plurality of expandable rings 30 which are separated by spacers 32 between them and at the end of the collet 10 opposite the piston 20. As the fluid pressure builds, forcing the piston 20 towards the expandable rings 30, these rings, which are typically solid rubber rings or donuts having a central opening with metal rings 28 fitted therein, increase in diameter and decrease in width. The spacers 32, which are typically formed of a material such as stainless steel or aluminum, are unable to expand, and thus distribute the force equally on the rings 30. The spacers 32 are designed and shaped to exert pressure only on the rubber rings and not on the metal insert rings. Thus, for example, the spacers 32 may be cut out in the areas of the metal rings. As the rings 30 expand they tightly grasp a forming tube 34 which is surrounding them. The spacers 32 and the expandable rings 30 are carried by the shaft 14 and rotate with it. The piston 20, the spacers 32, and the rings 30 are slidably mounted on shaft 19, except for the spacer (not shown) at the end opposite the piston 20, which is fixed in position.

When a complete forming package has been formed and it is desired to remove the forming package from the collet, fluid pressure is released from the fluid inlet 16, thus equivalently decreasing the pressure on the piston 20, the spacers 32, and the expandable rings 30. The spring 24 forces the piston 20 into its unexpanded position further relieving pressure on the expandable rings 30 and allowing them to return to their unexpanded state, i.e., with an increased width and decreased diameter. This loosens the grasp on the forming tube 34 and allows the operator to remove tube 34 with the accompanying forming package of strand thereon.

The complete pressurization of the collet to grasp the forming tube 34 may take place in a time period of about 0.5 to 1.5 seconds with a fluid pressure ranging from about 30 to about 55 psig (204,082 to 374,150 pascals). The depressurization may take place in about 1 to 3 seconds. The fluids which may be employed to pressure the system include liquid fluids such as water, but preferably are gaseous fluids such as nitrogen, oxygen, helium, and especially air.

EXAMPLE

Employing a collet 10 as illustrated in the drawings, having a diameter of 5.0 inches (12.7 centimeters), a forming tube 34 was placed on the collet 10 and air was supplied to the inlet 16 at a pressure of 50 psig (340,163 pascals) for a time period of 0.75 seconds at which time the expandable rings 30 firmly grasped the forming tube 34. Two thousand K-6.75 glass filaments were wound at a rate of 3000 feet per minute (914.4 meters per minute) for a period of 20 minutes to complete the square-edged forming tube. No eccentric rotation of the collet was noticed, the collet being substantially completely balanced in rotation. No slippage of the forming tube 34 on the collet 10 was noticed. The air pressure was released in 1.5 seconds and the forming tube 34 along with the forming package of glass strand was easily removed therefrom.

From the foregoing, it is obvious that the collet of the present invention provides an effective means for collecting glass strand which is free from problems encountered in the collet of the prior art.

While the invention has been described with reference to the specific embodiment thereof, it is not intended to be so limited thereby, except as insofar as in the accompanying claims.

We claim:

1. In a winder for collecting strand material on a hollow forming tube comprising a stationary shaft having a free outer end, a hollow shaft surrounding and rotatably mounted on said stationary shaft, means for rotating said hollow shaft on said winder, the improvement comprising;

a plurality of resilient rings slidably mounted on said hollow shaft and rotatable therewith, said rings each having peripheral surfaces adapted to engage and support a forming tube and surfaces on opposite sides thereof, a plurality of spacer members slidably mounted on said hollow shaft and rotatable therewith, said spacer members being disposed between the opposing side surfaces of adjacent resilient rings, each of said spacer members having radially extending flange portions adapted to engage the side surface of a resilient ring adjacent thereto, a fluid chamber secured to the outer end of said rotatable hollow shaft, said chamber having side and end wall portions, a piston slidably mounted in said fluid chamber for movement on the adjacent surfaces of said hollow shaft and the side wall of said fluid chamber to engage the side surface of an adjacent resilient ring and exert compressive forces on said resilient rings and said spacers therebetween, a fluid passage means mounted in said fluid chamber adjacent the outermost end thereof, valve means mounted in said fluid passage means to provide fluid flow into and from said fluid chamber, and spring means biased between an interior portion of said piston opposed to a side surface of an adjacent resilient ring to force said piston away from said slidably mounted resilient rings and spacers therebetween, whereby fluid under pressure may be introduced into said chamber and (a) maintained under pressure by said valve means to exert pressure continuously on said piston to expand said resilient rings and engage said forming tube, and (b) released from said chamber by said valve means to remove the pressure exerted on said piston and said resilient rings to effect immediate disengagement between said resilient rings and said forming tube.

2. The winder of claim 1 wherein said expandable rings are solid rubber rings having a central opening and having a metal ring fitted in said opening.

3. The winder of claim 1 wherein said fluid is air.

4. The winder of claim 3 wherein said air is at a pressure of between 30 and 55 psig (204,082 and 374,150 pascals).

* * * * *